US006926543B2

(12) United States Patent
Poh et al.

(10) Patent No.: US 6,926,543 B2
(45) Date of Patent: Aug. 9, 2005

(54) ELECTRICAL WIRING DEVICE WITH MULTIPLE TYPES OF WIRE TERMINATIONS

(75) Inventors: Patrick Poh, East Northport, NY (US); Juan M. Lopez, Jamaica, NY (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 09/952,098

(22) Filed: Sep. 15, 2001

(65) Prior Publication Data

US 2002/0016098 A1 Feb. 7, 2002

Related U.S. Application Data

(63) Continuation of application No. 09/426,458, filed on Oct. 25, 1999, now abandoned.

(51) Int. Cl.[7] ..... H01R 4/66; H01R 13/648; H01R 4/24; H01R 4/26; H01R 11/20

(52) U.S. Cl. ..... 439/107; 439/441

(58) Field of Search ..... 439/107, 106, 439/650, 441

(56) References Cited

U.S. PATENT DOCUMENTS 3,689,870 A * 9/1972 Jaconette ..... 439/650
3,694,790 A * 9/1972 Martin ..... 439/107
3,944,314 A * 3/1976 Weitzman et al. ..... 439/411
4,097,112 A 6/1978 Veldman et al.
4,172,628 A * 10/1979 Lingaraju ..... 439/441
4,392,707 A 7/1983 Holce et al.
4,422,701 A 12/1983 Anderson
5,472,350 A 12/1995 Mehta
6,109,937 A * 8/2000 Bonilla et al. ..... 439/107

* cited by examiner

*Primary Examiner*—Chandrika Prasad
(74) *Attorney, Agent, or Firm*—Paul J. Sutton

(57) ABSTRACT

A wiring device is provided with three different ways in which the bared end of an electrical conductor can be coupled to the contacts inside the body of a wiring device. A clamping plate is placed upon the threaded body of a terminal screw. In a first arrangement the bared end is formed about the terminal screw and trapped between the head of the terminal screw and a first surface of the clamping plate which forces the conductor into firm contact with the first surface of the clamping plate. In another arrangement the straight bared end of the conductor is trapped between a second surface of the clamping plate and a contact plate. The movement of the conductor and clamping plate is controlled by the terminal screw. Apertures are placed in the bottom of the device housing adjacement the contacts in the housing. A contact arm, formed as a one-way clutch grips the straight bared end of a conductor to make contact with the contacts of the device but prevents withdrawal of the conductor.

8 Claims, 4 Drawing Sheets

50
32
28
12
62

ELECTRICAL WIRING DEVICE WITH MULTIPLE TYPES OF WIRE TERMINATIONS

This application is a continuation of application Ser. No. 09/426,458, filed Oct. 25, 1999, now abandoned.

BACKGROUND OF THE INVENTION

1. Field of the Invention

The instant invention is directed to the field of wiring devices and more particularly to wiring devices having multiple means to connect electrical conductors to such wiring devices.

2. Description of the Prior Art

Prior art devices have terminal screws which permit the bared end of an electrical conductor to be placed under the head of such terminal screw or push-in sections which allow the bared end of an electrical conductor to be inserted therein or a combination of a terminal screw and clamping plate which traps the bared end of an electrical conductor between a clamping plate and a contact pad of a wiring device. Although one or two of these approaches are present in a single wiring device there is not a single wiring device which offer all three conductor to wiring device clamping techniques.

SUMMARY OF THE INVENTION

The instant invention provides a wiring device which provides all three of the above-described electrical conductor to wiring device wiring techniques. The wiring device has a number of contact pads, one for each contact of the wiring device. The surface of the contact pad is scored to permit it to better grip the bared end of an electrical conductor. A threaded aperture in the contact pad threadingly engages a threaded terminal screw. The bared end of an electrical conductor can be bent into a u-shape and placed about the threaded portion of the terminal screw and is engaged by the backside of the terminal screw head and front surface of a clamping plate. The u-shaped conductor can be closed into a circular shape before the terminal screw is tightened. A clamping plate is positioned on the terminal screw and is moved by the terminal screw towards the contact pad to trap the straight, bared end of an electrical conductor between the clamping plate and the contact pad. An aperture is provided in the bottom of the wiring device housing at each contact of the wiring device and partially blocked by the free end of a spring member formed as a one-way clutch. The bared end of an electrical conductor can be inserted in an aperture to displace the free end of the spring member. Any attempted withdrawal of the conductor forces the end of the spring member to bite into the conductor and prevent its withdrawal. It is an object of this invention to provide an improved wiring device.

It is an object of this invention to provide a novel wiring device which permits electrical conductors to be coupled thereto using three coupling means.

Other objects and features of the invention will be pointed out in the following description and claims and illustrated in the accompanying drawings, which disclose, by way of example, the principles of the invention, and the best mode which is presently contemplated for carrying them out.

BRIEF DESCRIPTION OF THE DRAWING

In the drawings in which similar elements are given similar reference characters.

DESCRIPTION OF THE PREFERRED EMBODIMENT

Figure 1:
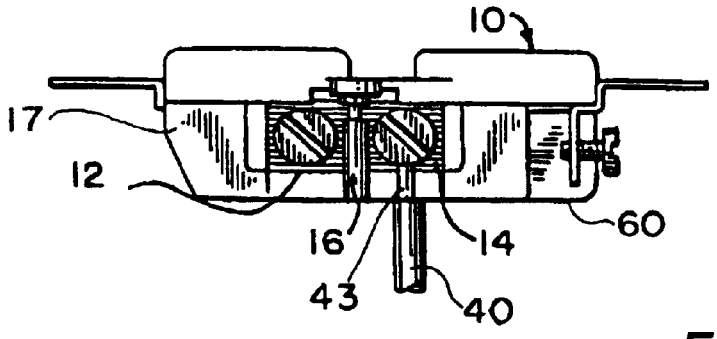
FIG. 1 is a front elevational view of a wiring device.
Figure 2:
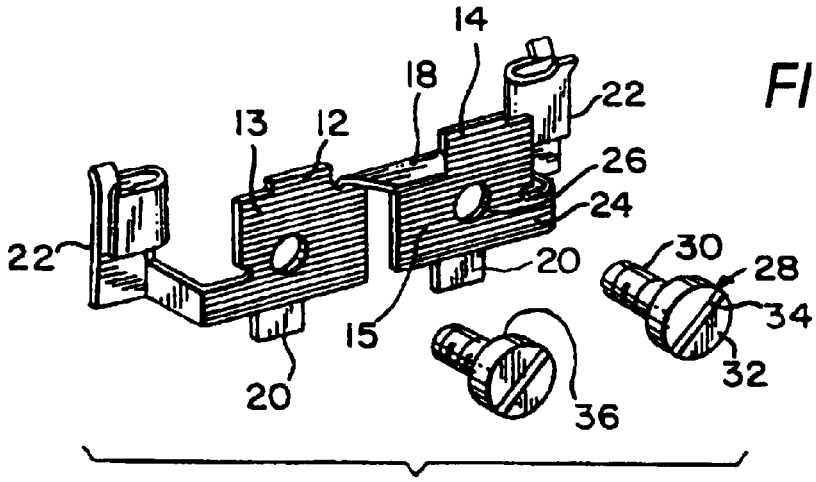
FIG. 2 is an exploded perspective view of the contact pads and terminal screws of the device of FIG. 1.
Figure 7:
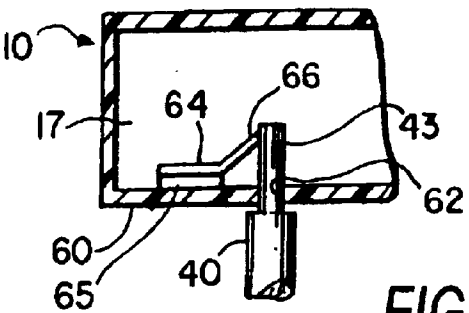
FIG. 7 is a fragmentary, partly in section, portion of the wiring device of FIG. 1.
Figure 6:
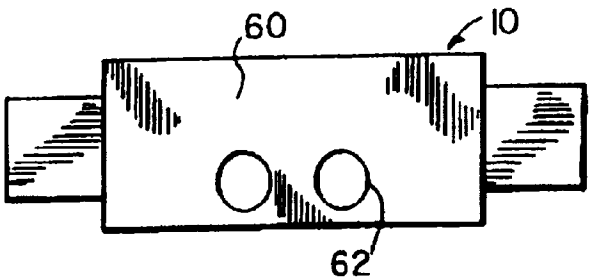
FIG. 6 is a bottom plan view of the wiring device of FIG. 1.
Figure 8:
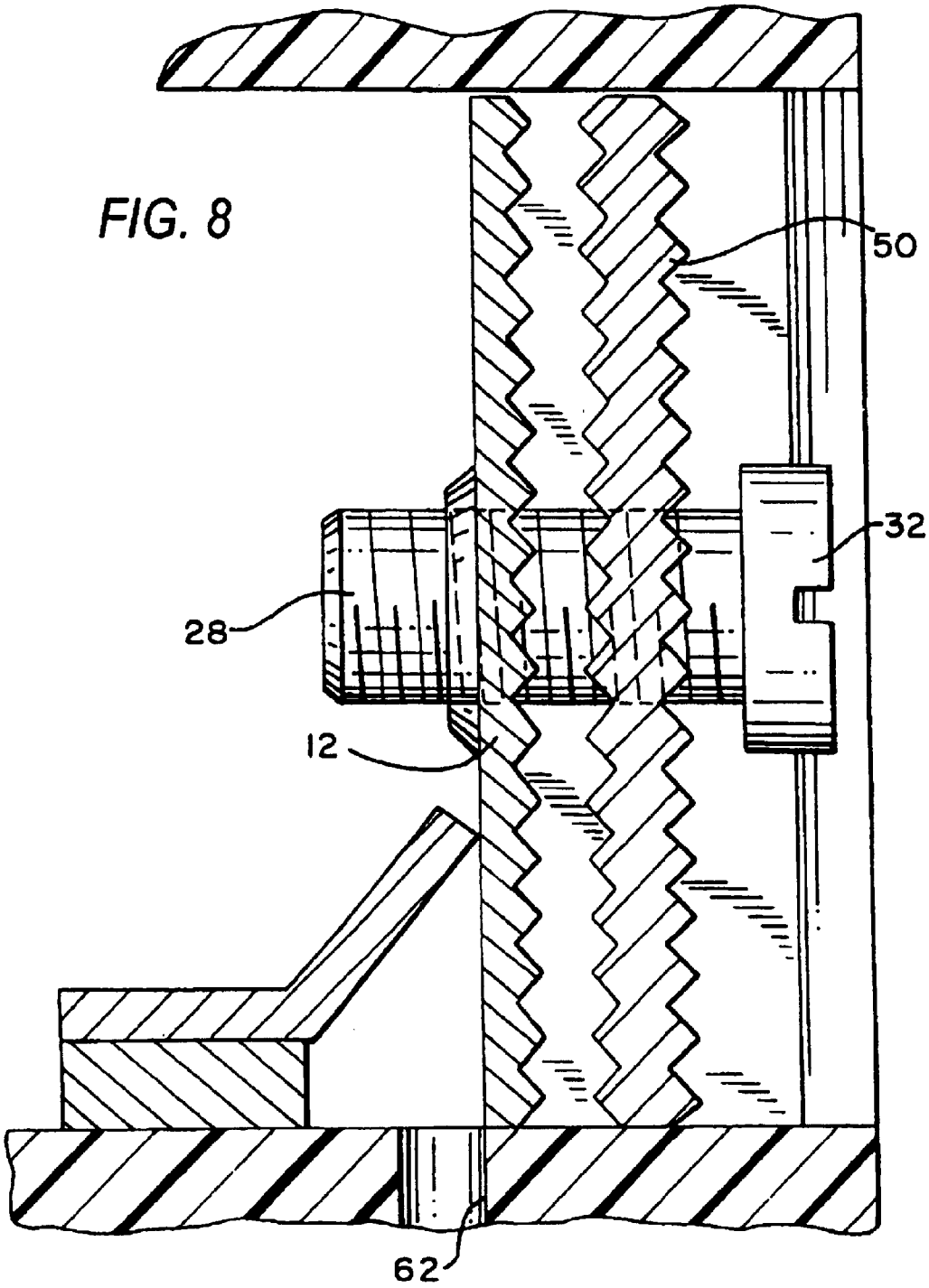
FIG. 8 shows the clamping plates mounted in a recess in the side of the wiring device and a spring electrically coupled to a contact pad.

Turning to FIGS. 1 and 2 there is shown a wiring device 10 which may be a receptacle, switch or the like. The wiring device 10 includes a body 17 having a bottom surface 60 with aperture 62 therethrough, as shown in FIGS. 6 and 7. Two contact pads 12 and 14 which fit in a recess within the side of the body of wiring device 10 are exposed to receive a bared end 43 of a conductor 40. A barrier 16 of insulating material is positioned so that the barrier 16 separates the contact pads 12 and 14 and is employed when the contact pads 12 and 14 are separately wired. A bridge 18 of metal joins the contact pads 12 and 14 if the circuits are wired in common, and may be removed when the circuits are to be separately wired. Tabs 20 and side wings 22 are employed as anchor elements to anchor the contact pads 12 and 14 in place in the body 17 of the wiring device 10. Each of front faces 13 and 15 , respectively, of the contact pads 12 and 14 are serrated as at 24 to better grip a conductor placed thereon. Further, each of the contact pads 12, 14 has a threaded aperture 26 therein to threadably engage the threaded portion 30 of a terminal screw 28. The terminal screw 28 has a head 32 which includes a slot 34 to receive a screw driver to tighten or loosen the terminal screw 28. The underside 36 of head 32 is made to bear on a conductor or a clamping plate as will be described below.

Figure 3:
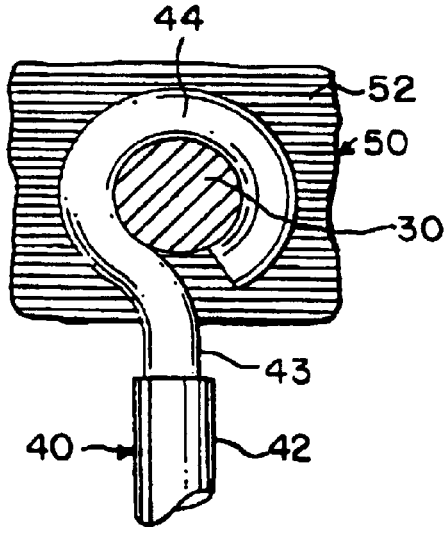
FIG. 3 is a front elevational view of the front surface of a clamping plate showing the bared end of an electrical conductor wrapped about a portion of a terminal screw, shown in section.

In a first way to attach a conductor 40 to a wiring device, the insulation 42 is stripped from one end of conductor 40 and the bared conductor 43 is generally bent into a u-shaped loop 44. Once it is placed about the threaded portion 30 of terminal screw 28 the u-shaped loop 44 may be further bent about threaded portion 3O to form a near full circle, shown in FIG. 3. The loop 44 is positioned between the serrated front face 52 of clamping plate 50 and the underside 36 of the terminal screw head 32. The terminal screw 28 is now advanced until the clamping plate 50 is in contact with the contact pad 12 and the loop 44 is trapped between the serrated front surface 52 of clamping plate 50 and the underside 36 of the terminal screw head 32.

Figure 5:
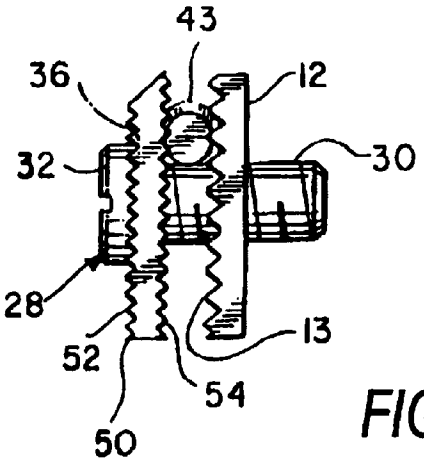
FIG. 5 is a side elevational view of the components of FIG. 4 assembled.
Figure 4:
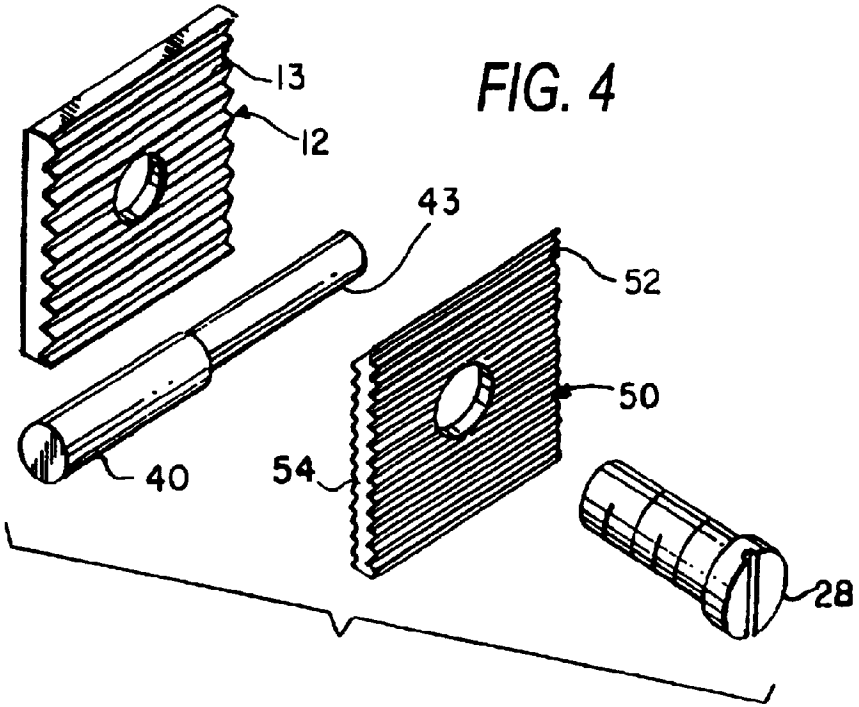
FIG. 4 is an exploded view of the contact pad of FIG. 2 with a clamping plate positioned between a terminal screw head and a contact pad.
Figure 9:
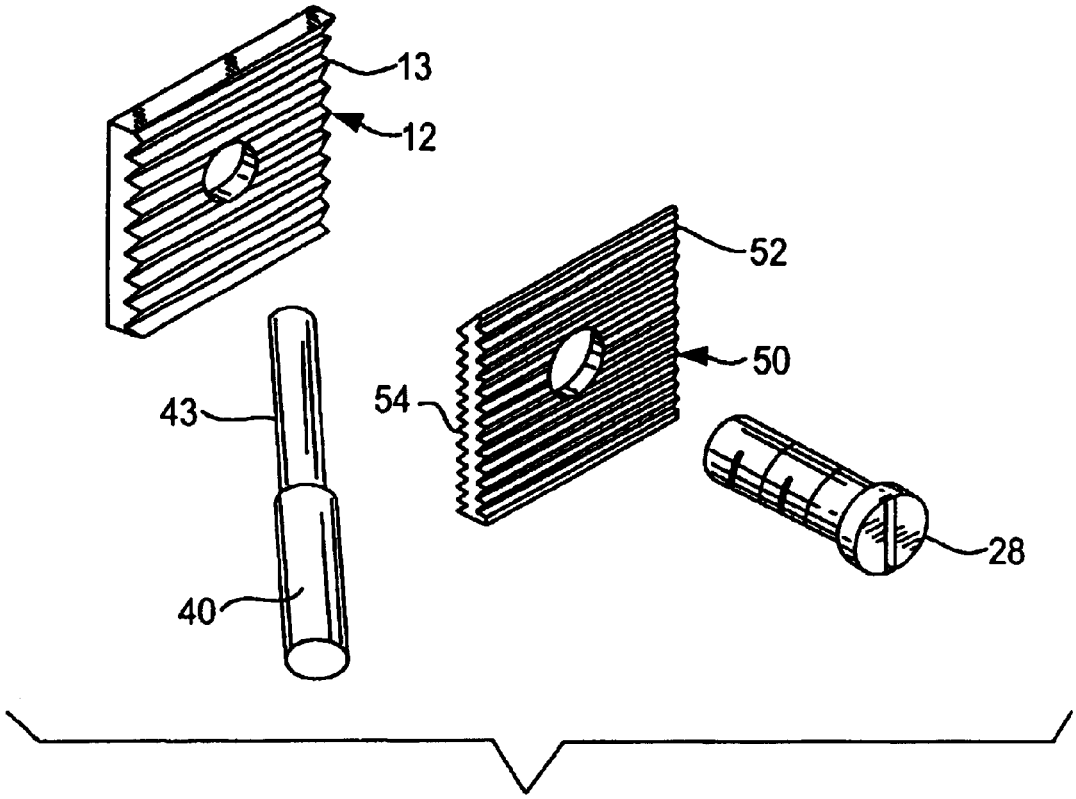
FIG. 9 is an exploded view of the contact pad of FIG. 2 with a clamping plate positioned between a terminal screw and a contact pad.

A second way in which the bared end 43 of an electrical conductor 40 can be attached to wiring device 10 is by trapping the bared end 43 of the electrical conductor 40 between the serrated rear face 54 of clamping plate 50 and the serrated front face 13 of the contact pad 12 as shown in FIGS. 4, 9 and 5. As shown in FIGS. 4, 9 and 5, the clamping plate 50 has serrations on the front and rear surfaces that are of equal number per inch and greater than the number of serrations per inch on the front face of contact pad 12. The bared end 43 of the conductor 40 is placed on the serrated front face 13 of contact pad 12 and the terminal screw 28 is advanced. The underside 36 of the head 32 bears on the front face 52 of clamping plate 50 and moves the clamping plate 50 towards the contact pad 12. Upon sufficient tightening of the terminal screw 28 , the bared end 43 of the electrical conductor 40 is held between the serrated rear face 54 of clamp plate 50 and the serrated front face 13 of the contact pad 12. The operation of a clamping plate with contact pad 14 is the same as described with respect to contact pad 12.

The bottom surface 60 of the wiring device 10 contains apertures 62 as shown in FIGS. 6 and 7, adjacent to the contacts in the wiring device 10. Adjacent to each aperture 62 is a spring metal contact 64 having a free end 66. The spring contact 64 is so shaped and biased that it acts as a one-way clutch. The bared end 43 of electrical conductor 40 when inserted in aperture 62 deflects the spring contact 64 which remains in intimate contact with the bared end 43. Any attempt to remove a conductor 40 causes the free end 66 to bite into bared end 43 and prevent withdrawal of the conductor 40. The intimate contact between the bared end 43 and the free end 66 of spring contact 64 provides the electrical connection between wiring device 10 and conductor 40. The push in method just described provides the third method of connecting the wiring device 10 to an electrical conductor 40.

While there have been shown and described and pointed out the fundamental novel features of the invention as applied to the presently preferred embodiment, it will be understood that various omissions and substitutions and changes of the form and details of the device illustrated and in its operation may be made by those skilled in the art, without departing from the spirit of the invention.

We claim:

1. An electrical wiring device with at least two types of wire terminations located in a body having first and second side surfaces, the electrical wiring device comprising:

a first pair of exposed contact pads mounted to the first side surface for connection to a first conductor and a second pair of exposed contact pads mounted to the second side surface for connection to a second conductor, said first and second pairs of contact pads being electrically isolated from each other and each contact pad having a front surface;

parallel serrations on the front surface of each of said first and second pairs of contact pads aligned with a longitudinal axis of the electrical wiring device and having a threaded aperture therethrough;

a plurality of terminal screws, one for each contact pad, each threadably engaging said threaded aperture in said contact pad, each terminal screw having a head and a threaded body extending therefrom;

a plurality of clamping plates, one for each terminal screw, each having a front surface and a rear surface, each clamping plate having parallel serrations on the front and rear surfaces aligned with each other and with the serrations on the front surface of the contact pads wherein the serrations per inch on the front and rear surfaces of the clamping plate are greater than the serrations per inch on the contact pads and wherein each clamping plate is placed on one of said plurality of terminal screws to permit the rear serrated surface of a respective clamping plate to be moved towards the front serrated surface of a respective associated contact pad to permit a bent bared end of a conductor to be placed about the threaded body of terminal screw and held between the head of terminal screw and the front serrated surface of its associated clamping plate to provide a first type of wire termination; or permit a straight end of a bared conductor to be placed between the rear serrated surface of an associated clamping plate and an associated serrated contact pad at a right angle to the parallel serrations to provide a second type of wire termination.

2. The electrical wiring device of claim 1, wherein each clamping plate is rectangular.

3. The electrical wiring device of claim 2, further comprising:

a plurality of anchor elements, including at least one tab and at least one side wing, for positioning the plurality of contact pads in the wiring device body.

4. The electrical wiring device of claim 2, further comprising:

a barrier for electrically isolating the first pair of contact pads from each other.

5. An electrical wiring device with at least three types of wire terminations located in a body having first and second side surfaces and a bottom surface, the electrical wiring device comprising:

a first pair of contact pads mounted in a recess in the first side surface and a second pair of contact pads mounted in a recess in the second side surface, the first and second pairs of contact pads being electrically isolated from each other, each contact pad being exposed, and each contact pad having a front surface, the front surface of each contact pad having parallel serrations which are aligned with a longitudinal axis of the wiring device and each contact pad having a threaded aperture therethrough;

a plurality of clamping plates, each clamping plate associated with a respective terminal screw having a head and a threaded body extending therefrom, each clamping plate associated with a respective contact pad and having a front surface and a rear surface, each of which has parallel serrations aligned with each other and with the serrations on the contact pads wherein each clamping plate is placed on the threaded body of a respective associated terminal screw to permit the rear serrated surface of the respective clamping plate to be moved towards the front serrated surface of a respective associated contact pad to permit the bared end of a conductor to be bent and placed about the threaded body of terminal screw and held between the head of terminal screw and the front serrated surface of its associated clamping plate to provide a first type of wire termination or remain straight and be placed between the rear serrated surface of a clamping plate and an associated serrated contact pad and at right angle to the parallel serrations to provide a second type of wire termination;

first and second pairs of apertures located in the bottom surface of the electrical wiring device wherein the first pair of apertures is associated with the first pair of contact pads and the second pair of apertures is associated with the second pair of contact pads, and a spring contact mounted adjacent to each aperture in the bottom surface of the body and electrically coupled to a contact pad wherein an end of the spring contact engages the bared end of a conductor inserted through the aperture to electrically couple the conductor to the electrical wiring device but prevent withdrawal of the conductor from the aperture to provide a third type of wire termination, the spring contact engages one surface of the barred end of the conductor and urges an opposite surface of the barred end of the conductor to be in electrical contact with a rear surface of the contact pad.

6. The electrical wiring device of claim 5, further comprising:

a barrier for electrically isolating the first pair of contact pads from each other.

7. The electrical wiring device of claim 5, further comprising:

a bridge for electrically coupling a second pair of the plurality of contact pads.

8. The electrical wiring device of claim 5, wherein each clamping plate is rectangular.

* * * * *

UNITED STATES PATENT AND TRADEMARK OFFICE

CERTIFICATE OF CORRECTION

PATENT NO. : 6,926,543 B2
DATED : August 9, 2005
INVENTOR(S) : Poh et al.

It is certified that error appears in the above-identified patent and that said Letters Patent is hereby corrected as shown below:

Column 2,
Line 15, "the side of the wiring device and a spring electrically" should read -- the side of the wiring device and a spring contact electrically --.
Line 51, "circle, shown" should read -- circle as shown --.
Line 51, "3O" should read -- 30 --.

Column 4,
Lines 60 and 61, "barred" should read -- bared --.

Signed and Sealed this

Fourteenth Day of March, 2006

JON W. DUDAS
*Director of the United States Patent and Trademark Office*